United States Patent [19]

Chalabian

[11] Patent Number: 4,844,567

[45] Date of Patent: Jul. 4, 1989

[54] VENDING MACHINE WITH CONTROLLED RETURN ACCESS DOOR

[76] Inventor: Jack S. Chalabian, 16245 Wayfarer La., Huntington Beach, Calif. 92649

[21] Appl. No.: 203,421

[22] Filed: Jun. 6, 1988

Related U.S. Application Data

[63] Continuation-in-part of Ser. No. 009,642, Jan. 27, 1987, abandoned, which is a continuation of Ser. No. 713,025, Mar. 18, 1985, abandoned.

[51] Int. Cl.[4] ..... A47F 3/00

[52] U.S. Cl. ..... 312/139; 49/274; 49/386; 16/52

[58] Field of Search ..... 49/273, 274, 386, 379; 312/237, 139; 16/52, 66, 68, 70; D20/6

[56] References Cited

U.S. PATENT DOCUMENTS

| | | | |
|---|---|---|---|
| D. 244,480 | 5/1977 | Burck | D20/1 |
| D. 273,023 | 3/1984 | Chalabian | D20/8 |
| 2,808,625 | 10/1957 | Wilkinson | 49/274 |
| 2,996,754 | 8/1961 | Ziegler et al. | 16/52 |
| 3,335,451 | 8/1967 | Patriquin | 16/52 |
| 4,576,271 | 3/1986 | Chalabian | 49/386 |

*Primary Examiner*—Kenneth J. Dorner
*Assistant Examiner*—Gerald A. Anderson
*Attorney, Agent, or Firm*—Beehler, Pavitt, Siegemund, Jagger, Martella & Dawes

[57] ABSTRACT

The prevent invention is directed to improvements in vending machines of the type having an access door which is opened by a purchaser for removing a purchased article from within the machine.

A two-stage hydraulic door closer is provided with a spring to return the access door through its arc of movement from the open to the closed position at a relatively slow, controlled, substantially uniform rate which allows a purchaser to open and release the door and then to remove an article from the interior of the vending machine with one hand without interference by the access door while the article is being removed.

7 Claims, 5 Drawing Sheets

VENDING MACHINE WITH CONTROLLED RETURN ACCESS DOOR

This is a continuation-in-part application of U.S. Ser. No. 009,642 filed Jan. 27, 1987, which in turn is a continuation of U.S. Ser. No. 713,025 filed Mar. 18, 1985, now abandoned.

FIELD OF THE INVENTION

The present invention relates generally to the field of vending machines, and is more particularly directed to improvements in vending machines of the type having an access door which is opened by a purchaser for removing a purchased article from within the machine, and provided with a device for slowly returning the access door to its closed position following a purchase.

STATE OF THE PRIOR ART

Vending machines, particularly of the coin-operated type, have been known for a long time, and have found widespread application notably for the sale of newspapers, magazines and the like. Typically, such vending machines include a housing in which is stored a supply of articles to be vended, e.g., a stack of newspapers, and an access door into the housing which is movable between a closed and an open position so as to allow removal of purchased articles from the machine housing. The access door is usually biased towards the closed position by means of coil springs, or sometimes by the weight of the door itself without assistance from any spring. Such bias is necessary in order to prevent a careless customer from leaving the door open, thus allowing removal of articles from the machine without payment. Such vending machines in the past have suffered from a number of shortcomings.

In locations where quiet operation is required, such as hospital waiting rooms, hotel lobbies, etc., vending machines of this type have proven undesirable due to repeated slamming of the door by careless customers who release the door after extracting the purchased articles. The spring bias causes the door to slam closed, creating startling noise.

A further shortcoming has been the repeated incidence of injuries to customers whose hands are caught by the door as it snaps shut. Such injuries have included broken fingers, cuts and bruises and have resulted in numerous and costly lawsuits against vending machine operators.

A still further and perhaps the most significant shortcoming has been the need for a patron of such a vending machine to use both hands during a purchase. One hand is required to hold the door open against the spring bias on the weight of the door, while the other hand extracts the purchased article from the interior of the machine. This shortcoming has resulted in the inability to provide this type of vending machine at curbside locations or by driveways for use by individuals sitting in an automobile. This is because it is very difficult and strenuous to reach out simultaneously with both hands through the window of a vehicle in order to operate presently available vending machines. Single-handed operation of vending machines would greatly facilitate their operation from inside a vehicle, and thus open up substantial new markets for such vending devices.

Presently used vending machines, in particular newspaper vending machines, include newspaper vending machines with a pull-up door, i.e., the door being hinged at its upper end and opened by lifting its lower end, and newspaper vending machines with a pull-down door, the door being hinged along its lower edge, and opened by pulling down its upper end. Both types of vending machines currently are provided with coil springs connected for returning the door to its closed position upon being released by the purchaser after the purchased article has been removed.

Coil springs alone as presently used do not allow substantial control over the time during which the vending machine door remains open. Rather, the door tends to accelerate continuously towards the closed position when released, and stops only upon impact with the vending machine housing. This repeated shock and jarring of the vending machine tends to loosen the various assemblies which make up the vending machine, reducing the life expectancy and reliability of operation of the machine, and consequently increasing costs of maintenance for the same.

SUMMARY OF THE INVENTION

The present invention improves over the presently known and used vending machines such as described above, by either replacing or supplementing the coil springs normally used for returning the access door to its closed position with a hydraulic door closer which returns the access door through its arc of movement from the open to the closed position at a relatively slow, controlled, substantially uniform rate which allows a purchaser to open and release the door and then to remove an article from the interior of the vending machine with one hand without interference by the access door while the article is being removed, and also without having to hold the door open with the other hand against the door closer device. The improvement disclosed herein thus allows one-handed operation of the vending machine.

The preferred means for returning the door to its closed position include a two-stage hydraulic door closer having a piston on a piston rod connected to either the door or the machine frame and displaceable through a stroke in a cylinder containing hydraulic fluid, the cylinder being connected to the other of the door or the frame. The piston displacement towards the closed position is opposed by hydraulic fluid flow through restricted conduit openings formed in the piston. An internal spring in the cylinder biases the piston towards the closed position through a first active stage of the piston stroke which first stage terminates short of the closed position. The piston is subsequently displaceable though a second, passive stage of the piston stroke where no internal bias is applied to the piston which moves against the resistance of the hydraulic fluid alone. The internal spring is a coil spring about the piston rod and fixed at one end to the cylinder in spaced relationship from the piston when the piston is in fully retracted position in the cylinder, such that the piston moves through a passive portion of its stroke free of the internal spring against hydraulic fluid resistance alone. The stroke of the hydraulic closer is thus characterized by an active closing region of positive, relatively high closing force near the fully extended end of the stroke and a passive damping region of zero closing force between the first region and the fully retracted end of the stroke.

In the case of a pull-down door hinged along its lower edge to the frame, the hydraulic closer is assisted by an external spring, such as a coil spring, connected between the frame and the door urges the door to its fully closed position through its stroke. Consequently, the door is subjected to relatively high combined closing force of the hydraulic closer's internal spring and the external spring from its open position through the aforementioned active stage of the piston stroke, followed by the lower closing force of the external spring alone acting against the resistance of the hydraulic fluid in the closer cylinder through the passive stage of the piston stroke near the closed position of the door.

The bias force of the internal and external springs is preferably such that neither spring means alone is sufficient for lifting the door from its open position to its closed position. It will be apparent that considerably greater lifting force must be applied to the door when it is near its fully lowered, open position that when it is near its upright, closed position. The two springs cooperate to lift the door from its fully open position through a first portion of the closing arc at which point the internal spring ceases to act on the door. Thereafter, the external spring alone completes the door movement to the closed position at a closing rate damped by the passive resistance of the hydraulic fluid to piston displacement.

It is advantageous for the hydraulic door closer to have an adjustable rate of closure so as to compensate for varying weights of display newspaper copies supported on the access door. This weight can vary widely, e.g., from a thin weekday to a heavy Sunday edition of a particular newspaper.

This two-stage hydraulic door return unit can be used alone, i.e. unassisted by any external spring, in pull-down doors hinged along a lower horizontal edge of the type where the upper end of the door leans into the housing in its closed position such that the arc of movement of the door between its open and closed positions includes an intermediate vertical position of the door. The two-stage door return unit is constructed or adjusted such that the first or active stage of the closer's stroke corresponds to the portion of the arc lying between the open position of the door and a position just past the vertical position but short of the closed position, while the second or passive stage of the closer's stroke corresponds to the arc portion between the first region and the closed door position, such that the hydraulic door closer operates to damp the gravity assisted movement of the door towards its sloping closed position once past the vertical position.

In the case of pull-up door, i.e., where the access door is hinged along an upper edge thereof to the housing for movement through an arc between a lowered closed position and a raised open position, the internal spring of the hydraulic closer operates to positively return the access door from the open to the closed position through the active stage of the closer in cooperation with the downward pull of gravity on the door. The hydraulic closer, however, is characterized by a closing rate which is substantially constant throughout the arc of door movement and damped by the resistive flow of hydraulic fluid thereby opposing the tendency of gravity to accelerate the downward movement of the door and providing for smooth and gentle closing of the door at a measured rate which permits single-handed operation of the vending machine, particularly in drive-up installations. The two-stage hydraulic closer, as described, provide internal spring bias only through an active portion of its stroke and the positive action of the closer ceases short of the fully closed position of the door, allowing gravity alone to complete the closing of the door through the passive portion of the closer stroke at a controlled rate against the continued resistance of the hydraulic fluid to prevent slamming of the door.

DETAILED DESCRIPTION OF THE PREFERRED EMBODIMENTS

Figure 1:
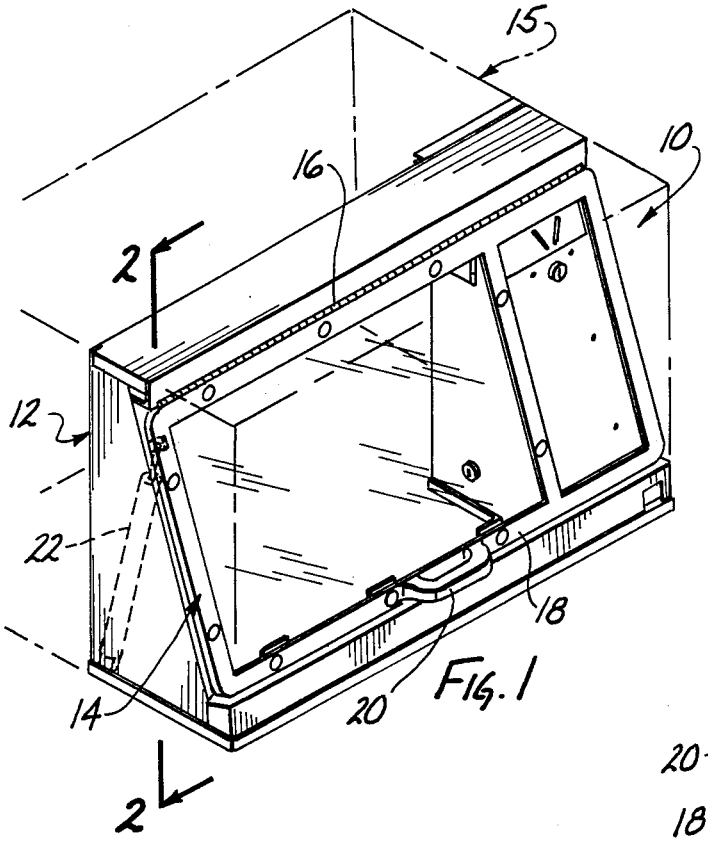
FIG. 1 is a perspective view of a coin-operated pull-up door module for a newspaper vending machine according to this invention.
Figure 2:
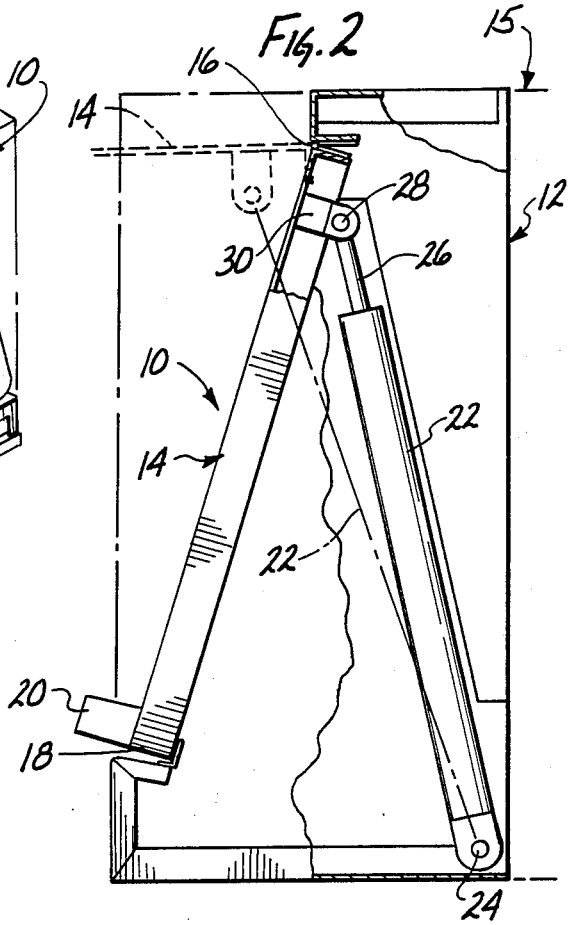
FIG. 2 is a cross section in side elevation along line 2—2 of FIG. 1 showing the hydraulic door closer installed in the access door module of FIG. 1.

With reference to the drawings where common elements are indicated by like numbers, FIG. 1 shows a coin-operated access door module for a newspaper vending machine for insertion into the open front of a rectangular machine housing 15 suggested in phantom lining in FIGS. 1 and 2. The door module 10 comprises a module frame 12, a generally rectangular access door 14 which has an upper edge 16 hinged to the frame 12 and a lower edge 18 provided with a handle 20 for pulling up the lower edge of the door away from the frame 12 so as to open the door and gain access to the articles to be vended (not shown in the drawings) stored inside the machine housing 15. A hydraulic door closer 22, shown in dotted lining in FIG. 1, is connected between the module frame 12 and a point of the access door 14 near the upper hinged end 16.

The mounting of the hydraulic door closer 22 is better understood by reference to FIG. 2. There it will be seen that the door closer consists of a cylinder mounted at its lower end to a frame 12 by means of pivot 24. A piston rod 26 extends from the upper end of the cylinder, and is pivotably secured at its upper end 28 to a bracket 30 mounted to the access door 14 near the upper hinged end 16. When the access door 14 is opened by pulling up its lower end to an open position suggested in phantom lining in FIG. 2, the bracket 28 moves through an arc with the door 14, and pulls the piston rod 26 out of the hydraulic actuator cylinder, also pivoting the actuator 22 about the lower pivot 24 to a position suggested by the phantom line in FIG. 2.

An example of a hydraulic door closer suitable for use with the present invention is disclosed in U.S. Pat. No. 2,966,754 to Ziegler, et al. That patent describes a hydraulic door closer suitable for use on relatively lightweight doors such as those found on newspaper vending machines. This hydraulic door closer provides a uniform closing rate which is adjustable so as to optimize the rate of closure of the access door of the vending machine. The optimum door closer rate is sufficiently slow to allow a purchaser to comfortably remove the purchased article from the machine without undue haste and without being obstructed by partial closure of the door before the transaction has been completed, yet not so slow as to remain open after the purchaser has had adequate opportunity to remove his purchase and has left the vicinity of the machine. Such protracted opening of the access door would only invite tampering or vandalism, or unnecessarily expose the interior of the machine to the elements, e.g., rain, etc. As described in the Ziegler patent specification, the hydraulic closer is designed to maintain a substantially steady rate of closure throughout the arc described by the door. Further, the rate of closure remains substantially constant regardless of the point of release of the door, i.e., regardless of whether the door is released from a fully, partly or slightly open position. The more commonly available inexpensive hydraulic or pneumatic door closers should be avoided, since many such low cost devices allow the door to travel rapidly without resistance for 75 to 80 degrees of arc, and then abruptly slow down the door, just prior to closing. Such door closers are nearly useless in connection with the present invention. The primary object of this invention is to allow one-handed operation of the vending machine, and not merely to soften the closure of the vending machine access door. While the latter is highly desirable, it is a benefit which flows out of the aforesaid primary object.

Figure 4:
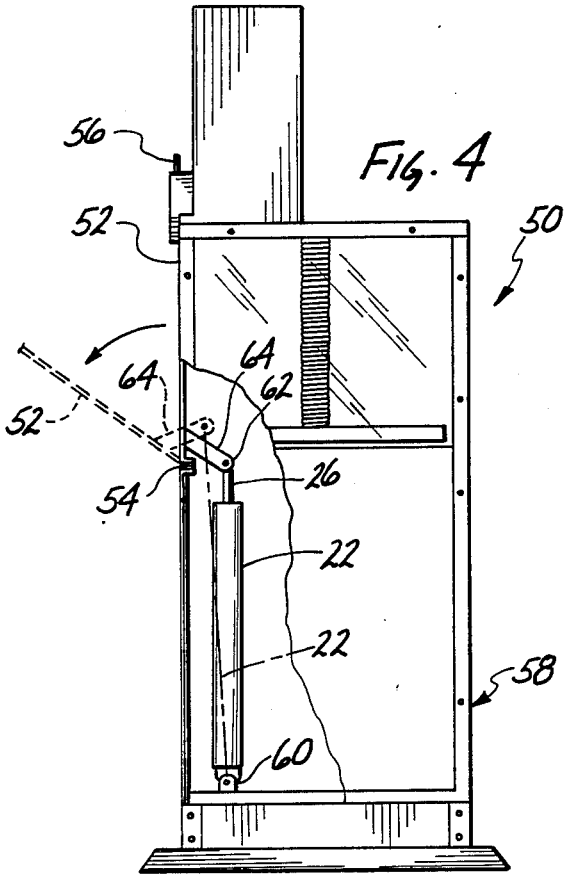
FIG. 4 is a view in side elevation of the vending machine of FIG. 3, broken away to show the hydraulic door closer installed therein, and also showing in phantom lining the hydraulic device in its extended position when the door is opened.
Figure 3:
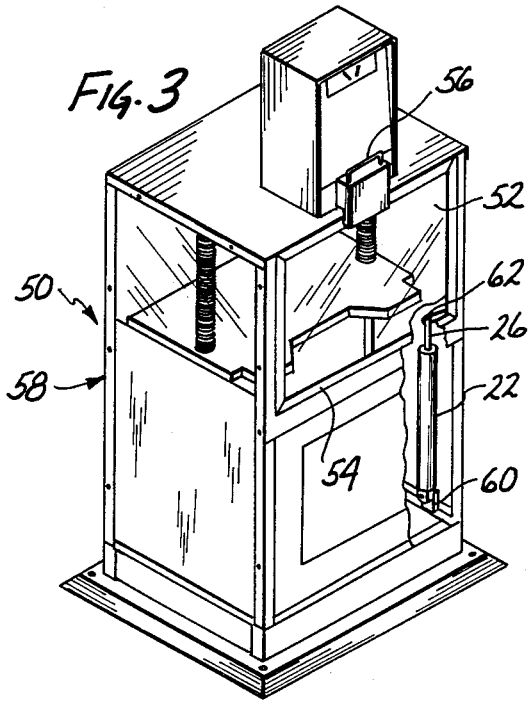
FIG. 3 is a perspective view of a newspaper vending machine with pull-down access door, broken away to show a hydraulic door closer installed therein according to the present improvement.

Turning now to FIG. 3, a vending machine 50 is shown provided with a pull-down access door 52, that is, an access door hinged along its lower edge 54, as best appreciated by reference to FIG. 4, and which is opened by pulling down on a handle 56 affixed to its upper edge towards the open position shown in dotted line in FIG. 4. The vending machine of FIGS. 3 and 4 is provided with a hydraulic door closer 22 similar to that of FIGS. 1 and 2, and which is connected between a lower portion of the vending machine housing and a point of the access door 52 near the lower hinged edge 54. The lower end of the door closer 22 is pivotably mounted at 60 to the housing 58 near the base thereof, while the piston rod 26 is pivotably connected at its upper end 62 to a bracket 64 attached to the access door 52 just above the hinged edge 54. When the access door 52 is moved towards the open position shown in phantom lining in FIG. 4, the bracket 64 moves through an arc with the door and extends the hydraulic closer 22 by pulling out the piston rod 26 from the cylinder, as indicated by the phantom line 22. The axial extension of the closer 22 compresses an ,internal spring in the closed cylinder, and when the door 52 is released, the spring expands to retract the piston rod 26 into the closer cylinder. The force of this internal spring is counteracted by a hydraulic fluid which fills the actuator cylinder and causes the internal piston to travel at a controlled rate under the urging of the internal coil spring, all as explained in greater detail in the referenced Ziegler et al. patent. The operation of the hydraulic door closer is essentially the same in connection with the embodiment of FIGS. 1 and 2.

Although hydraulic door closers of many types and vending machines with spring loaded access doors have been long known and widely used, they have never until now been combined vending machines, in spite of the benefits to be obtained from such combination, and in spite of a long-felt need to overcome the clear shortcomings of uncontrolled door springs in vending machines. To reiterate, these benefits include silent operation which allows installation of the improved vending machines in areas previously closed to them, such as public areas in hospitals, hotel lobbies and numerous other public indoor spaces; improved safety of operation by eliminating injuries caused by spring loaded doors slamming shut; lowered maintenance and extended service life of the vending machines due to elimination of shock and vibration caused by previous spring loaded doors; and the possibility of one-hand operation which still further increases the possible locations available for installation of these vending machines by making them usable by individuals sitting in their automobiles. Even in locations where none of the aforesaid considerations apply, an increase in sales may be expected by making purchases from such vending machines far more convenient to persons carrying packages or shopping bags or who have one hand otherwise tied up.

Figure 5:
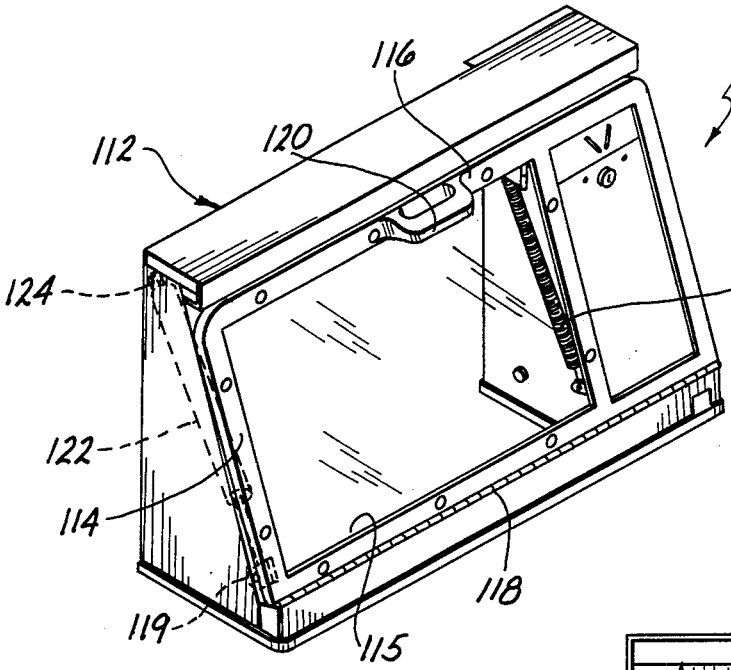
FIG. 5 is a perspective view of a pull-down access door module for a newspaper vending machine provided with both a mechanical coil spring and hydraulic door closer according to one form of the present invention.

FIG. 5 shows a coin operated access door module 100 for a newspaper vending machine generally similar to that shown in FIG. 1 and includes a module frame 112, a generally rectangular access door 114 which has a lower edge 118 hinged to the frame 112, and an upper edge 116 provided with a handle 120 by means of which the upper edge of the access door is pulled down away from the frame 112 so as to open the door and gain access to the machine housing (not shown) where the articles to vended are stored. The vending machine equipped with an access door module 100 is improved by provision of a two-stage hydraulic door closer unit 122, shown in phantom lining, which is connected between the module frame 112 and a point of the access door 114 near the lower hinged end of the door, as best understood by reference to FIG. 6.

Figure 8:
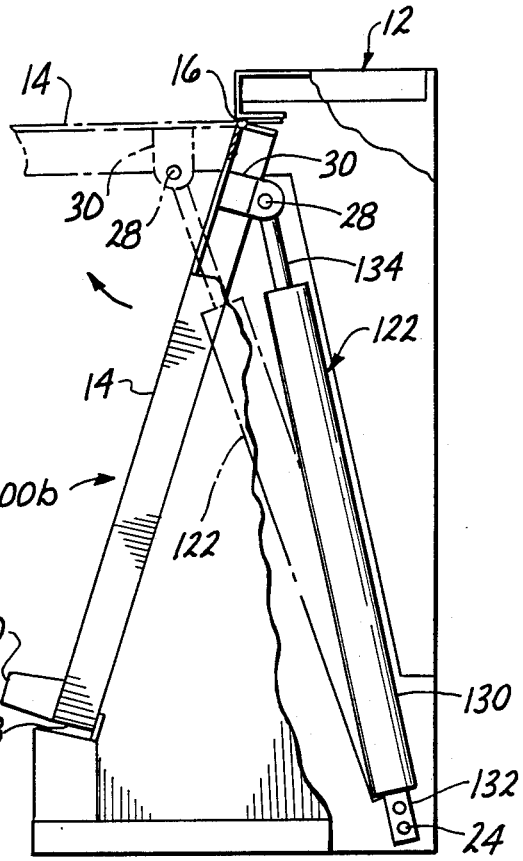
FIG. 8 is an elevational cross section of an access door module such as that of FIG. 1 but in which the door is hinged at its upper horizontal edge and is pulled up to its open position and provided with a two step hydraulic closer unit.
Figure 9:
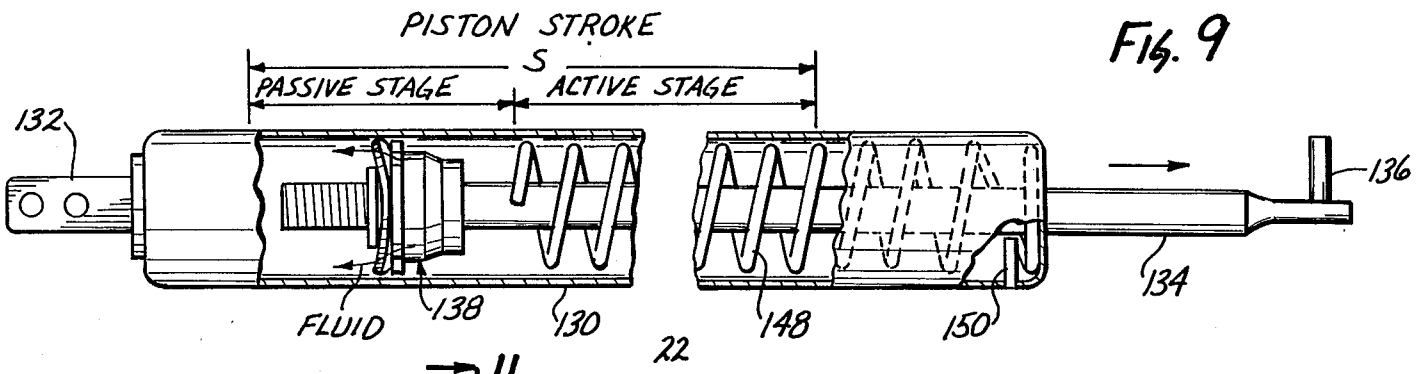
FIG. 9 is a longitudinal view partly in section of a two stage door closer a hydraulic door closer suitable for use in this invention.
Figure 11:
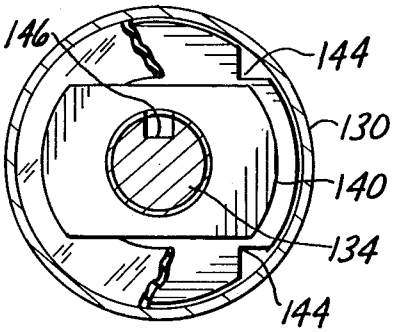
FIG. 11 is a transverse section of the hydraulic closer taken along lines 11—11 in FIG. 10.
Figure 10:
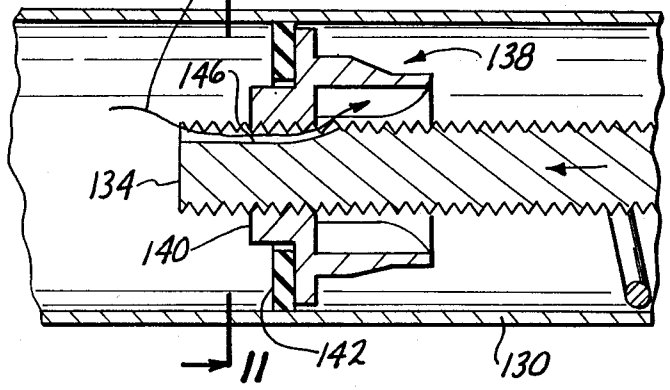
FIG. 10 is an enlarged fragmentary axial section showing the ported piston head assembly of the hydraulic closer of FIG. 9.

FIGS. 9 through 11 illustrate the interior construction and operation of the two-stage hydraulic door closer 122 suitable for use in any of the door modules or vending machines of FIGS. 5–8 and 12–13. The hydraulic closer 122 comprises a cylindrical housing 130 which is sealed at both ends and filled with a hydraulic fluid. At one end of the housing is a mounting tab 132 which is pivotable attached at 124 by suitable fasteners to the vending machine housing 112, while a piston rod 134 is axially slidable through the opposite end of the housing 130 between a retracted and an extended position. A tranverse pin 136 is fixed to the free end of the piston rod for mounting purposes and in the present application the pin 136 is engaged into a hole provided in an actuating arm 119 fixed to the access door as shown in the drawings. A piston head assembly 138, better seen in the enlarged cross section of FIG. 10, is threaded onto the inner end of the piston rod 134 and includes a piston head 140 on which is supported a flexible annular flat washer 142 such that it makes a circumferential seal with the inner wall of the cylinder 130. The piston head 140 includes notch cutouts 144 circumferentially spaced at 90 degree intervals which are normally covered and closed against fluid flow by the washer seal 142. During extension of the piston rod 134 as when the vending machine access door is pulled open, the washer seal 142 yields under hydraulic fluid pressure bending away from the piston head along its outer rim to uncover the notch openings 144, thus providing additional passages for the hydraulic fluid through the piston head so as to minimize resistance due to the hydraulic damping, leaving only the force of spring 148 to be overcome by manual pulling on the access door. During compression of the hydraulic closer, i.e., piston rod movement towards its retracted position, leftward in FIG. 10, the flexible seal 142 lies against the piston head 140 and closes the notch openings 142. Hydraulic fluid is therefore forced through an axial slot 146 defined in the inner end of the piston rod 134 and providing a passageway fluidically communicating the opposite sides of the cylinder 130 separated by the piston head 138 as shown in FIGS. 10 and 11. The passageway slot 146 is of limited aperture and restricts hydraulic fluid flow through the piston head. The hydraulic fluid being virtually incompressible, it imposes a substantially steady rate of movement of the piston assembly through the cylinder 130 determined primarily by the aperture of the slot 146. The combined effect is to provide for a damped, steady rate of movement of the piston rod 134 into the cylinder 130. An internal coil spring 148 is held against the bottom end of the cylinder 130 by retaining pin 150. The axial length of the spring 148 is shorter than the length S of the piston stroke as indicated in FIG. 9, so that the piston 138 is free from the spring 148 through a passive stage of the stroke S, as indicated in the drawing. Traveling leftward beyond this distance, the piston 138 compresses the spring 148 and enters the active stage of the piston stroke in which the piston is positively biased towards its retracted position. The effective aperture of the passageway 146 is variable by shifting the position of the piston head 140 along the threaded portion of rod 134 due to the curved bottom of the slot 146 in the rod. This adjustment can be made by turning the piston rod 134 while the piston head 138 is held against rotation by friction or other means. The passageway 146 can be closed off completely by displacing the piston head to the right of the slot. The variable passageway aperture permits control over the fluid flow rate across the piston head and consequently over the rate of closure of the door closer 122. For convenience, the mounting tab 132 may be rotatably attached to the cylinder 130, so that adjustment of closure rate of the device 122 may be conveniently made in an installed closer by simply turning the cylinder 130 while the rod 134 is held by the machine frame.

Returning to FIG. 5, the upper end of the door closer 122 is hinged at 124 to the module frame 112 while the free end of the piston rod is hinged to a short arm 119 connected to the door 114 near its lower hinged end 118. The module 100 also is provided with a mechanical coil spring 126 which is secured in a manner similar to that of the hydraulic door closer 122 but on the opposite side of the door 114 as shown in FIG. 5. Upon pulling of the door from its solid lined closed position to the phantom lined open position, the piston rod attached to the door is pulled to an axially extended position from the closer's cylinder 130, compressing the closer's internal spring 148. Opening of the access door also stretches the door return spring 126 from a normal retracted condition to a stretched condition tending to pull back the door 114 towards its generally upright and closed position in cooperation with the hydraulic closer unit 122. Upon release from the fully open position, the access door 114 is pulled up by both the external coil spring 126 and the internal closer spring 148 through the portion of the door's closing arc requiring maximum lifting force due to the door's outward extension from the frame 112. The closer 122 is configured and adjusted so that the internal spring 148 is fully decompressed and ceases to bias the piston head once the door 114 has reached approximately an upright position. Thereafter, the door is urged towards its closed position only by the action of the external spring 126 while the closer passively operates to dampen the rate of closure of the door by opposing the tendency of the spring 126 to accelerate the door.

The door return spring 126 carries a substantial portion of the weight of the access door 114 and relieves the hydraulic closer 122 of this burden, prolonging the life and increasing the reliability of the hydraulic closer 122. As a result, a relatively small capacity hydraulic closer unit 122 may be employed in combination with the spring 126. The hydraulic closer 122 opposes the tendency of the spring 126 to accelerate and slam the access door 114 against the module frame 112 and provides for a steady and controlled movement of the access door 114 throughout its arc of movement from the open to its closed position, allowing the customer to pull open the access door and withdraw the purchase from the vending machine with a single hand before the door closes. The hydraulic closer unit 122 is selected to provide a door closing time in the approximate range between 8 and 30 seconds, with a time of 12 to 15 seconds through its full arc of movement being preferred. In selecting the hydraulic closer unit 122 consideration is taken of the force exerted by the return spring 126 and also the weight added to the door 114 by any display copies of newspaper or the like which may be mounted on the door against the transparent window 115, as is customary in the industry. The size of newsprint publications varies widely from very lightweight local newspapers to Sunday editions of major metropolitan newspapers comprising hundreds of pages. When placing a display copy on the access door of a vending machine it is customary to place the entire newspaper including all supplements, advertising matter, etc., so that when the supply stacked in the machine is exhausted a customer may remove the display copy as the last copy to be sold. Because of the consequent wide variation in the total door weights to be pulled up from a horizontal to a vertical position, the hydraulic door closer 122 is preferably made adjustable in the closing force contributed by it and consequently in the door closing rate which is primarily determined by the hydraulic closer, to allow service personnel to make the appropriate adjustment when changing from a weekday edition to a Sunday edition of a particular newspaper. Since each vending machine is usually installed for the sale of a particular newspaper or other publication, the weight range of the display copies will be known and appropriate initial selection of both hydraulic closer 122 and return spring 126 may be made for the particular weight range.

Figure 6:
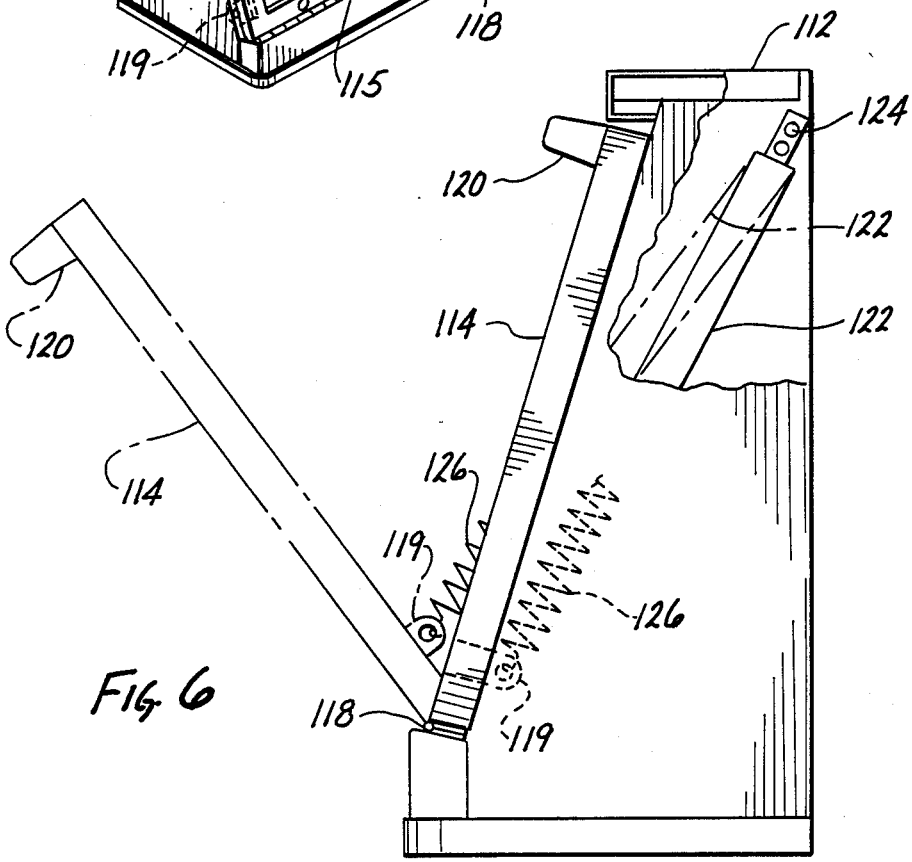
FIG. 6 is a side elevational section of the module of FIG. 5 also showing the door in partly open position in phantom lining.
Figure 7:
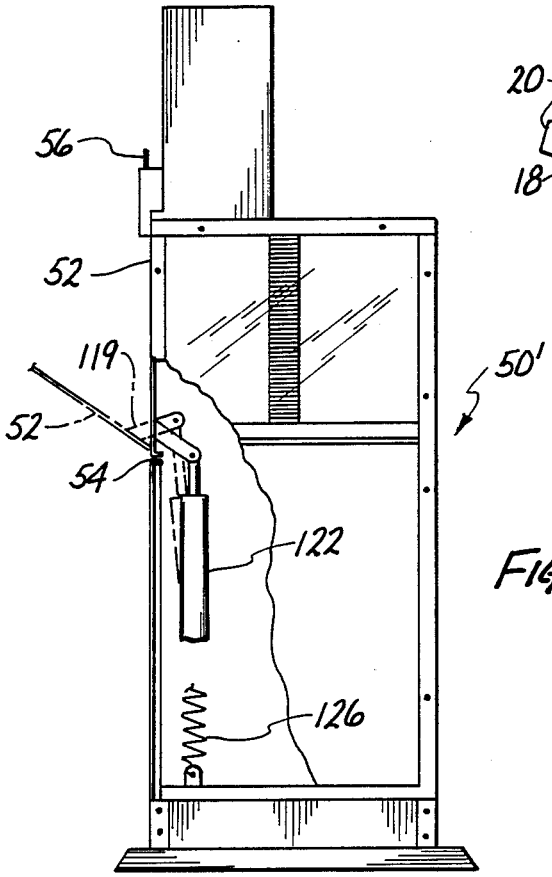
FIG. 7 is a side elevational view, partly in section, showing a newspaper vending machine with pull-down access door and provided with both a hydraulic door closer and external coil spring according to this invention.

FIG. 7 illustrates a vending machine 50*a* similar to that shown in FIGS. 3 and 4 but improved according to this invention by provision of the two-stage hydraulic door closer 122 in combination with a mechanical coil spring 126 which co-operate in a manner essentially similar to that described in connection with the pull-down door module 100 of FIGS. 5 and 6, although the physical arrangement and connection of the hydraulic closer and door spring in FIG. 7 are different due to the different physical configuration of the vending machine.

Figure 12:
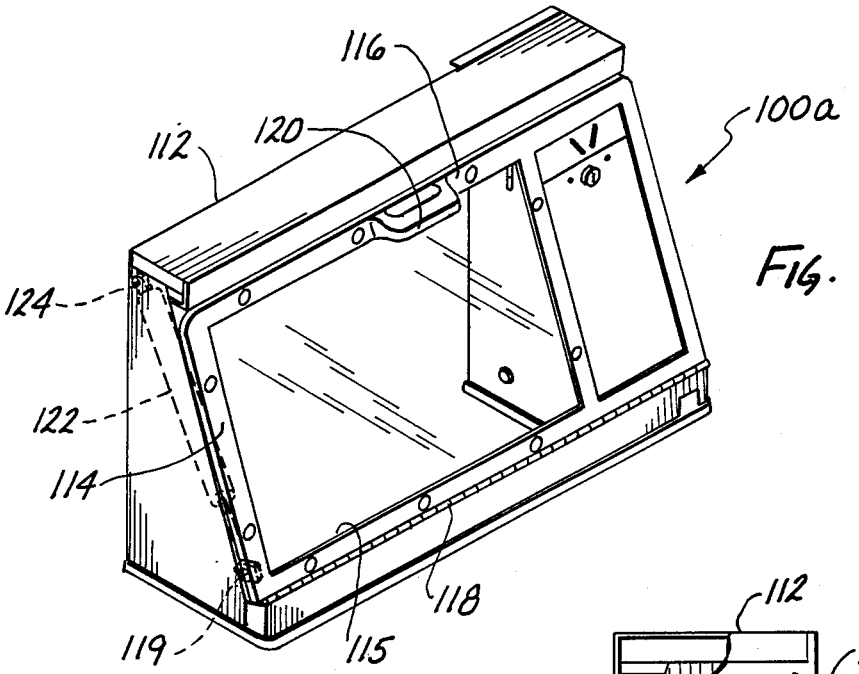
FIG. 12 is a side elevational view of a pull-down door module as in FIG. 5 provided only with a two-stage hydraulic door closer unit unassisted by any external spring.
Figure 13:
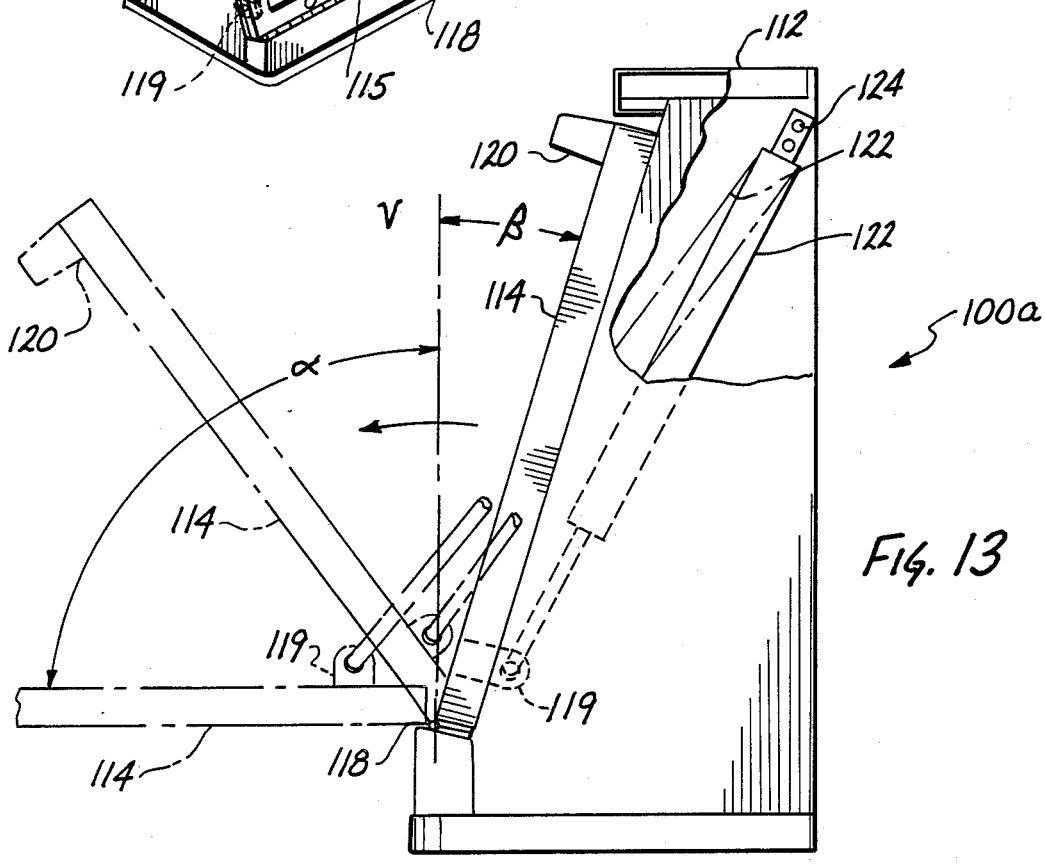

Turning now to FIGS. 12 and 13, a pull-down access door module 100*a* constructed generally as in FIGS. 5 and 6, but differing therefrom in that the two-stage door closer unit 122 is unassisted by any mechanical coil springs. In this embodiment of the invention advantage is take of the fact that the door 114 in its closed position leans into the frame 112 and must pass through an intermediate upright position V in moving from an open position suggested in phantom lining to its closed position. The two-stage closer unit 122 as already explained in connection with FIGS. 9–11 is characterized by a piston stroke including a region of zero closing force associated with a portion alpha of the access door's closing arc and a region of positive closing force in a portion beta of the door's arc of movement. The transition between the two regions alpha and beta occurs preferably just past (to the right of) the vertical door position V indicated in dotted lining in FIG. 11. Once the access door 114 passes the point V while moving towards its closed position shown in solid lining, the arc portion alpha is a descending arc and the access door 114 is drawn by gravity towards its fully closed position. The portion beta of the arc of movement, on the contrary, is an ascending arc and the access door must overcome gravity to reach its vertical position V. The two stage closer 122 therefore operates to actively pull up the door from its fully open position in the arc region alpha and in the arc portion beta the closer 122 passively operates to damp, regulate and slow down the door's movement for a gentle, quiet closing without shock to the machine frame 112 and minimal likelihood of injury to a patron, even to one whose hand remains in the door opening.

FIG. 8 shows a door module 100*b* generally as in FIG. 1 and 2 with the difference that a two-stage hydraulic door closer such as described in connection with FIGS. 9–11 has been installed. The pull-up door 14 hinged at its upper edge is manually lifted from the solid lined closed position to its phantom lined open position against the bias of the internal closer spring 148. When released in an open position, the closer 122 initially cooperates with gravity to actively pull down the door 14 at a measured and steady rate giving a patron sufficient time to withdraw a purchase from the machine interior. After traveling through the active portion of the closer stroke, at which point the door is relatively close to its closed position, the internal spring bias of the closer ceases and the door 14 continues downward movement under the pull of gravity at a rate controlled and damped by the passive resistance of the closer 22, as has been explained, to close the door quietly and without impact.

While particular embodiments of the invention have been shown and illustrated for purpose of clarity, it will be understood that many changes, substitutions and modifications will become apparent to those possessed of ordinary skill in the art. Therefore, the scope of the invention is limited only by the following claims.

What is claimed is:

1. An improved vending machine of the type comprising a housing for storing a supply of articles to be vended, an access door hinged to said housing for movement through an arc between a closed and an open position, and means for returning said access door from said open to said closed positions wherein said means for returning include a hydraulic door closer comprising a piston connected to one of said door or said frame said piston displaceable through a stroke between said open and closed positions in a cylinder containing hydraulic fluid, said cylinder connected to the other of said door or said frame;

said piston displacement towards said closed position being opposed by hydraulic fluid flow through restricted conduit means in said piston;

first spring means in said cylinder urging said piston towards said closed position through a first stage of said stroke terminating short of said closed position; and second spring means between said frame and door urging said door to said closed position throughout said stroke;

and wherein said first spring is a coil spring about a piston rod connected to said piston, said coil spring being secured to said cylinder in spaced relationship from said piston when said piston is in fully retracted position in said cylinder, such that the piston moves through a second stage of said stroke against said hydraulic fluid alone before engaging and compressing said coil spring whereby said door is subjected to relatively high closing force at said open position and a lower closing force near said closed position.

2. The vending machine of claim 1 wherein said second spring means alone is insufficient for moving said door to said closed position.

3. The vending machine of claim 1 wherein said access door is hinged to said housing along a lower horizontal edge of said door and is pulled down at its top edge for movement towards said open position.

4. The vending machine of claim 1 wherein said second spring means comprise at least one coil spring.

5. The vending machine of claim 1 wherein said hydraulic door closer has an adjustable rate of closure so as to compensate for varying weights of display newspaper copies supported on said access door.

6. The vending machine of claim 1 wherein said door is a pull-down door hinged along a lower horizontal edge thereof and has display means for displaying a copy of the articles being vended.

7. The improved vending machine of claim 1 wherein said access door is a pull-down door hinged along a lower edge, said door sloping into said housing in said closed position such that said arc includes a vertical position of said door between said open and closed positions, said means for returning being adjusted such that said first spring means are operative for returning said door past said vertical position but short of said closed position, said hydraulic closer means being operative thereafter for damping the movement of the door towards said sloping closed position under the urging of said second spring.

* * * * *